United States Patent [19]

De Beul et al.

[11] 4,216,290

[45] Aug. 5, 1980

[54] COATING OF VISCOUS AQUEOUS GELATIN COMPOSITIONS ON A CONTINUOUS WEB SUPPORT

[75] Inventors: Victor F. De Beul, Mortsel; Jan H. Van Hove, Berchem, both of Belgium

[73] Assignee: AGFA-GEVAERT N.V., Mortsel, Belgium

[21] Appl. No.: 948,819

[22] Filed: Oct. 5, 1978

Related U.S. Application Data

[63] Continuation-in-part of Ser. No. 759,991, Jan. 17, 1977, abandoned, which is a continuation of Ser. No. 576,739, May 12, 1975, abandoned.

[30] Foreign Application Priority Data

May 22, 1974 [GB] United Kingdom ..... 22902/74

[51] Int. Cl.[2] ..... G03C 1/78; G03C 1/96

[52] U.S. Cl. ..... 430/496; 427/358; 427/420; 427/44; 430/531; 430/935

[58] Field of Search ..... 96/87 R; 427/358, 420, 427/44 R

[56] References Cited

U.S. PATENT DOCUMENTS

| | | | |
|---|---|---|---|
| 2,681,294 | 6/1954 | Beguin | 96/85 |
| 3,526,536 | 9/1970 | Spengos et al. | 427/445 |
| 3,645,773 | 2/1972 | Herzhoff et al. | 96/67 |
| 3,756,828 | 9/1973 | Yoneyama et al. | 96/87 R |
| 3,767,410 | 10/1973 | Brust et al. | 96/94 |
| 3,786,002 | 1/1974 | Van Paesschen et al. | 96/87 R |
| 3,856,530 | 12/1974 | Van Paesschen et al. | 96/87 R |
| 3,911,172 | 10/1975 | Van Paesschen et al. | 96/87 R |

FOREIGN PATENT DOCUMENTS

| | | | |
|---|---|---|---|
| 837095 | 12/1957 | Fed. Rep. of Germany | 96/87 R |
| 1030178 | 5/1958 | Fed. Rep. of Germany | 96/87 R |

OTHER PUBLICATIONS

Renfrew et al., Polythenes, "The Technology and Use of Ethlene Polymers" (1957), pp. 400, 4001, 412 and 413.

Pierce, Industrial and Specialty Papers, vol. I, pp. 53–70.

*Primary Examiner*—Jack P. Brammer

*Attorney, Agent, or Firm*—William J. Daniel

[57] ABSTRACT

In an extrusion coating process of the flow-stretch type in which a ribbon of an aqueous gelatin coating composition is extruded through an elongated orifice onto a moving support and becomes stretched and attenuated in thickness between the orifice and support, at least one visco-elasticity enhancing agent is added to the coating composition in sufficient amount as to disproportionately increase the elasticity of the composition compared to its viscosity so as to render the composition stretchable at viscosities which are substantially reduced compared to what would otherwise be necessary for flow-stretch coatability.

10 Claims, 6 Drawing Figures

COATING OF VISCOUS AQUEOUS GELATIN COMPOSITIONS ON A CONTINUOUS WEB SUPPORT

This application is a continuation-in-part of Ser. No. 759,991, filed Jan. 17, 1977, now abandoned, which is a continuation of Ser. No. 576,739, filed May 12, 1975, now abandoned.

This invention relates to an extrusion coating process of aqueous gelatin-containing solutions on a continuously moving web, in particular of aqueous gelatinous compositions for the formation of photographic layers on film and paper supports.

In a process for coating a layer on a web according to the extrusion coating process, also known as "flow-stretch coating", a liquid coating composition is pumped through a narrow orifice, thereby forming a ribbon of coating composition which is received on a continuously moving web while said web is being conveyed over a web-supporting roller. The web travels at a speed 2 to 30 times in excess of the speed at which the ribbon of coating composition is forced out of the extrusion orifice. As a consequence of this speed difference, the flow of coating composition is stretched from 2 to 30 times.

Advantages of this coating system are the separation existing between layer formation and layer application, the uncritical distance between the web and the extrusion orifice, and the use of relatively concentrated coating compositions resulting in fast gelation and rapid drying of the coated layer of layers. The simultaneous extrusion of two or three layers is possible and the fast solidification of the layers may dispense with a gelling zone, and necessitates a very short drying zone only. Finally, high coating speeds can be realised.

When applied to the coating of gelatin-containing photographic layers, it has been shown that viscosities of the coating composition ranging between 2,000 and 1000,000 cps are required in order to carry out successfully the extrusion coating process. However, at these high viscosities the gelatin solutions become unmanagable in practice; that is to say, it is possible to flow-stretch extrude such compositions, but it is practically impossible to prepare them in the form of useful photographic dispersions and to agitate, stir and pump such compositions in a practical system.

It is the object of the present invention to provide an improved extrusion coating process that does not show the mentioned inconveniences.

According to the present invention, an extrusion coating process in which a coating composition is forced at a given linear rate out of a narrow extrusion orifice in the form of a ribbon and received on the surface of a continuously moving support spaced from said orifice a distance of about 0.5–1.5 mm, said support travelling at a linear rate of 2–30 times the rate of extrusion of said ribbon, whereby said ribbon is stretched at the same rate in the range of 2–30 times and correspondingly attenuated as it is laid upon said web, is characterized thereby that said coating composition is aqueous and contains about 2–20% by weight of gelatin, and that the viscosity and elastic properties of said coating composition are adjusted by the inclusion therein of at least one viscoelasticity-enhancing agent in a proportion within the range of about 1–60% by weight of said gelatin and which is sufficient to impart to said coating composition a viscosity $\eta$ of from 136 to 1000 cps when measured at 38° C. at a shear rate of 1735 $s^{-1}$, and a modulus of elasticity $\gamma$ of 10 to 300 dyne/sq.cm when measured at 38° C. and at 5 Hz, the corresponding range of the relaxation time $\tau$, being from 0.0045 to 1.0 s.

The relaxation time $\tau$ is the quotient of $\eta$ by $\gamma$, and thus $\tau = 10^{-2}$. $\eta/\gamma$ for $\tau$ being expressed in s, $\tau$ being expressed in cps, and $\gamma$ being expressed in dyne/sq.cm, $10^{-2}$ being a factor for converting centipoises to poises.

The addition of the viscoelasticity-enhancing agent allows the application to the web by extrusion-coating of layers of varying thickness, preferably of layers having a thickness in the wet state of 8 to 125 $\mu$m.

The invention allows the coating of layers in the manufacturing of black-and-white as well as of color photographic material. In the case of black-and-white material, the layers may have a suitable range of the modulus of elasticity comprised between 10 and 75 dyne/sq.cm. In the case of color material, said range may be extended from 10 to 300 dyne/sq.cm.

In the case of the simultaneous application of several layers by means of an extrusion coater having more than one extrusion orifice, it is sufficient that the coating composition for one layer meets the above described requirements. The other layers may then be carried by the layer having the rheologic characteristics according to the present invention.

Various chemical compounds can be used to give the coating composition the required viscoelastic characteristics.

A first class of suitable chemical compounds is formed by the polymers carrying sulphate or sulphonic acid groups. Suitable polymers and copolymers bearing sulphonic acid side groups which can be used according to the invention are e.g. polyvinyl sulphonic acid, and polymers and copolymers of styrene sulphonic acid. The following can also be used:

(a) Polymers and copolymers of substituted acryl- and methacrylamides of the formula:

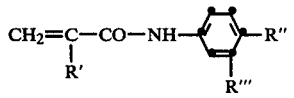

(b) Polymers and copolymers of substituted acrylates and methacrylates of the formula:

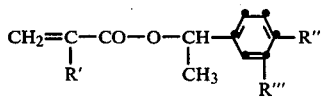

(c) Polymers and copolymers of substituted vinyl esters of the formula:

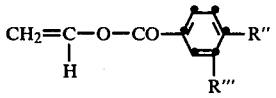

(d) Copolymers of substituted maleamic acid of the formula:

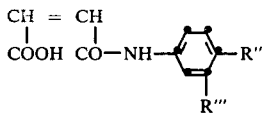

(e) Polymers and copolymers of N-sulphobenzoylated vinyl amines of the formula:

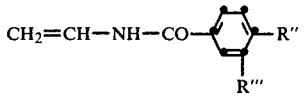

(f) Polymers and copolymers of substituted acrylates and methacrylates of the formula:

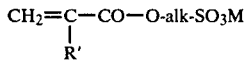

(g) Polymers and copolymers of substituted acryl- and methacrylamides of the formula:

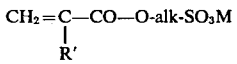

In these formulae

"alk" represents a straight-chain or branched-chain alkyl group of 1 to 4 carbon atoms;

M is hydrogen, an alkali metal atom or an alkaline earth metal atom;

R′ is hydrogen or methyl; and each of R″ and R‴ (which may be the same or different) represents hydrogen, a sulphonic acid group or a salt thereof, at least one of R″ and R‴ being a sulphonic acid group or a salt thereof.

All the polymers and copolymers bearing sulphophenyl side-groups can be prepared e.g. by hydrolysis of the corresponding polymers and copolymers comprising fluorosulphonylphenyl side groups, by the method described in the U.K. Pat. Nos. 932,620 and 939,250.

The sulphoalkyl-substituted polyacrylates and polymethacrylates are obtained by reaction of polyacryloyl chloride or of polymethacryloyl chloride with an hydroxyalkyl sulphonic acid.

In the two last cases, the reference to polyacryloyl chloride and polymethacryloyl chloride includes homopolymers of acryloyl chloride or of methacryloyl chloride as well as copolymers containing acryloyl chloride and methacryloyl chloride units.

The sulphoalkyl-substituted polyacrylates, polymethacrylates, polyacrylamides, and polymethacrylamides can also be obtained by homopolymerization or copolymerization of the sulphoalkyl-substituted acrylates, methacrylates, acrylamides, and methacrylamides.

The amount of polymers or copolymers bearing sulphonic acid or sulphonate side-groups required to give the aqueous gelatin solutions the desired viscoelastic characteristics, diminishes with increasing molecular weight of the polymer or copolymer. So, it is advisable to use polymers or copolymers of high molecular weight since in that case less polymer is needed to obtain the desired properties.

Very interesting results are obtained when using the polymer carrying sulphonate or sulphonic acid side-groups, especially polystyrene sulphonic acid in combination with compounds comprising polyvalent ions, e.g. Al(III) and Cr(III) as is the case in chrome alum and chrome acetate.

A second class of suitable viscoelasticity-increasing agents which may be used alone or in combination with the polymers carrying sulphonate or sulphonic acid side-groups especially with polystyrene sulphonic acid, are the linear polysaccharides in which (1) at least $\frac{1}{3}$ part of the monosaccharide units have a 1–2 bond and the remaining monosaccharide units have a 1–4 bond or (2) substantially all monosaccharide units have a 1–4 bond and at least 50% of the hydroxyl groups of the monosaccharide units are acetylated or replaced by a $OSO_3Me$ group in which Me represents an alkali metal.

Examples of such polysaccharides are the polymers synthetised biologically by biosynthesis with special bacterial strains and which are called after the bacteria that cause the biosynthesis such as e.g. B-1459 and B-1973. This manner of notation is commonly used in the literature and permits an unequivocal specification of the polysaccharides. More details about the above mentioned polysaccharides B-1459 and B-1973 can be found in Can. J. Microbiol., 9, 427 (1963) by D. G. Orentas et al, Can. J. Chem., 46, 3, 353 (1968) by J. K. Sloneker et al; Appl. Microbiol., 13, 272 (1965) by L. L. Wallen et al; Biochem. Biophys. Acta 69 by M. E. Slodke and in the U.S. Pat. Nos. 3,000,790, 3,383,307, 3,391,061 and 3,516,983.

A further example of a suitable polysaccharide is the cellulose sulphate KELCO SCS, made by KELCO Company, N.J., USA, and which corresponds to the following formula:

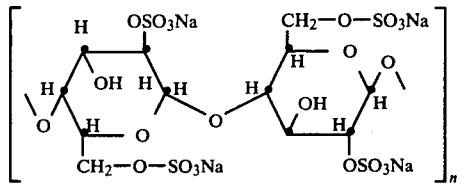

Another commercial product that is suited for the process of the invention is KELZAN, made by KELCO Company, and which corresponds to the polysaccharide B-1459.

All types of gelatines normally used in the photographic industry can be employed, e.g. gelatins rich in calcium, gelatines poor in calcium and calcium-free gelatines.

The viscoelasticity-enhancing agents can be added separately or in mixed condition to the coating composition, e.g. 2 to 60% by weight of polystyrene sulphonic acid, 1 to 10% by weight of chrome alum or chrome acetate, and 1 to 10% by weight of cellulose sulphate calculated on the weight of gelatin.

The gelatin concentration of the coating compositions itself may vary within rather large limits. Gelatin concentrations as low as 2% may be used, but the gelatin concentration may also be much higher and amount up to 20% by weight.

Depending on the layer thickness to be coated, the gelatin concentration, and the coating rate, one, or a mixture of two or three of these chemical compounds is (are) added. The examples clearly illustrate the way how this process is applied.

According to the above described extrusion coating technique coating compositions can be coated, which are from 30% to over 200% more concentrated in gelatin than compositions commonly used in dip coating, in air-knife coating, or in cascade coating. Thanks to the very fast gelatin that is characteristic of these highly concentrated composition, running becomes impossible, so that the coating quality is manifestly more uniform than that obtained with other coating systems. The greater distance (0.5 to 1.5 mm) from coater to support makes it possible to avoid pencil lines or strips due to dust particles, or to web splices as notably occurs in the case of cascade coating.

The coating compositions of the invention can be used for extrusion coating layers on suitable supports including cellulose ester film, polystyrene film, polyethylene terephthalate film and other related films of resinous materials as well as on glass, paper, metal, and the like, provided they are continuously moved along the extrusion orifice.

This invention is useful in producing photographic film elements including multicolour films, both positive and negative printing papers, X-ray films, motion picture films, portrait films, lithographic films and papers. It is not only useful in coating the light-sensitive silver halide colloid layers but also in the coating of light-filter layers, and anti-halation layers containing dyes and pigments which absorb the desired wavelengths of light, as well as of anti-abrasion layers and substratum layers from aqueous solutions, including aqueous ethanol solutions. In these layers gelatin constitutes the film-forming binding agent.

The invention will be described hereinafter on hand of different examples and with reference to different figures wherein.

EXAMPLE 1

Figure 1:
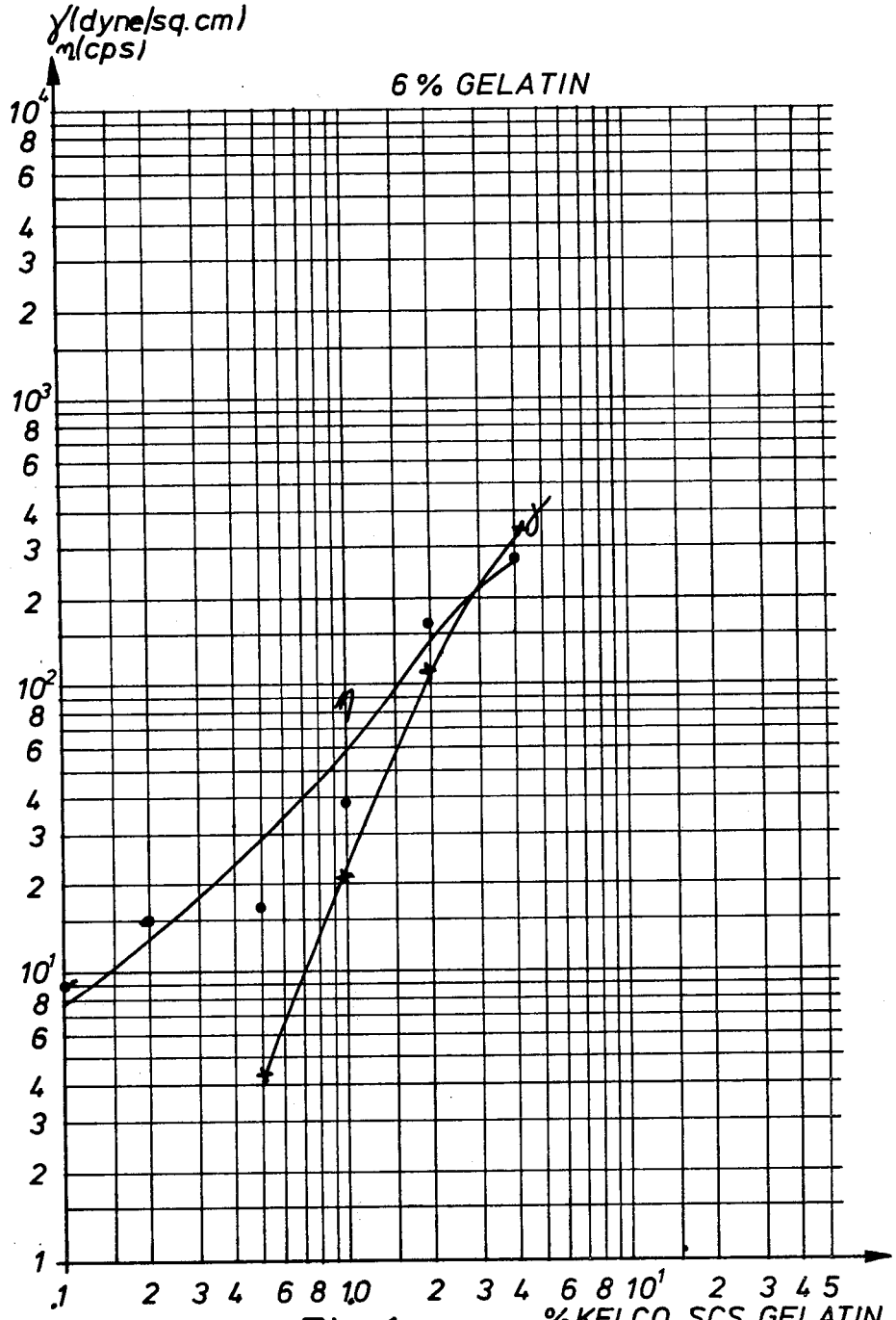
FIG. 1 is a graph illustrating the viscosity $\eta$ and the modulus of elasticity $\gamma$ of a 6% gelatin solution as a function of the concentration of KELCO SCS, of example 5.

After the addition of the usual sensitizing agents, stabilizing agents and wetting agents, 100 parts of a 2% aqueous solution of cellulose sulphate and 30 parts of a 20% polystyrene sulphonic acid solution in water are added to a coarse-grained high sensitive dispersion, containing 277 parts of silver halide and 100 parts of gelatin per 1000 parts of dispersion.

It should be noted that the gelatin which is used in the present example and also in all the other examples, except example 7, of the present specification, is a relatively high viscosity type of gelatin, namely gelatin that is free of inorganic salts, notably calcium salts.

The cellulose sulphate used was the commercial product KELCO SCS, made by KELCO Company. This cellulose sulphate had a degree of substitution of 2.5 and had a viscosity at 25° C. of 500 cP. The polystyrene sulphonic acid had a molecular weight of approximatively 55,000. The viscosity of the resulting dispersion, measured on a viscosimeter of Ferranti-Shirley at 1735 $s^{-1}$ and a temperature of 38° C. was 350 cP. The modulus of elasticity $\gamma$ was 25 dyne/sq.cm when measured at 38° C. and at 5 Hz on a Weissenberg rheogoniometer. The corresponding relaxation time $\tau$ was 0.14 s. The composition was coated at a wet layer thickness of 0.03 mm. The concentration of solids was increased by 90% as compared with other coating techniques.

Simultaneously with an antistress solution, whose gelatin content was only 3% by weight and whose viscosity was approximately 15 cP at 38° C., this highly viscous liquid composition was coated at 38° C. on a subbing layer by means of an extrusion nozzle with two separate chambers discharging into a common exit orifice. Both layers were pressed out of the extrusion orifice at a rate of 7.3 $m.min^{-1}$ whereas the support moved at a rate of 60 $m.min^{-1}$. The distance between the coater and the support was 0.9 mm.

The coating quality of the light-sensitive dispersion layer and of the antistress layer was excellent. The additives were found to have no influence on the photographic or physical characteristics of the material.

EXAMPLE 2

80 parts of a 20% solution of polystyrene sodium sulponate and 10 parts of a 10% solution of chrome alum were added to a silver halide dispersion containing 191 parts of silver halide, 115 parts of gelatin, 695 parts of water, 40 parts of an aqueous saponine solution, and 160 parts of an aqueous latex of polyethyl acrylate. The viscosity of this dispersion measured on a Ferranti-Shirley viscosimeter at 1735 $s^{-1}$ at 38° C. was 470 cP. The modulus of elasticity $\gamma$ was 13,42 dyne/sq.cm, measured at 38° C. and at 5 Hz on a Weissenberg rheogoniometer. The corresponding relaxation time $\tau$ was 0.35 s. The composition was coated at a wet layer thickness of 0.06 mm. The concentration of solids had increased by 50% as compared with other known techniques.

The composition was coated on the support simultaneously with an antistress solution containing 40 parts of gelatin, 100 parts of an aqueous saponine solution, 80 parts of a 10% aqueous polystyrene sodium sulphonate solution and 820 parts of water by means of an extrusion die with separate chambers and a common exit orifice. The average flow rate from the extrusion die was 25 $m.min^{-1}$ whereas the moving speed of the support was 85 $m.min^{-1}$. The distance between the coater and the support was 0.65 mm.

The quality of the light-sensitive silver halide layer with the antistress layer applied simultaneously thereto was excellent.

EXAMPLE 3

50 parts of a 20% aqueous polystyrene sodium sulphonate solution were added to 950 parts of an aqueous manganese dioxide dispersion containing 36 parts of manganese dioxide, 147 parts of gelatin, 50 parts of a latex of polyethylacrylate, 10 parts of an aqueous Tergitol solution, and 50 parts of an aqueous silicon dioxide. The resulting coating composition had a viscosity of 465 cP measured on a viscosimeter of Ferranti-Shirley at 38° C. and a shear rate of 1735 $s^{-1}$. The modulus of elasticity $\gamma$ was 46.5 dyne/sq.cm measured at 38° C. and at 5 Hz on a Weissenberg rheogoniometer. The corresponding relaxation time $\tau$ was 0.1 s. The coating composition was applied to a subbed cellulose triacetate support at a weight of 65 g/sq.m. The flow rate of the coating composition from the extrusion nozzle was 26.6 $m.min^{-1}$ whereas the moving speed of the cellulose triacetate support was 80 $m.min^{-1}$. The distance between the coater and the support was 0.8 mm.

The resulting layer had an excellent quality.

EXAMPLE 4

110 g of gelatin, 137 g of an aqueous latex of polyethyl acrylate, and the usual amounts of sensitizing agents and stabilizing agents were added to 1 l of a light-sensitive silver halide dispersion containing an amount of silver halide corresponding to 275 g of silver nitrate. A solution of sodium cellulose sulphate was added also in such an amount that 1.6 g of solids were present.

The resulting emulsion had a viscosity of 136 cP at 38° C. and 1735 $s^{-1}$. The modulus of elasticity $\gamma$ was 13,6 dyne/sq.cm measured at 38° C. and at 5 Hz on a Weissenberg rheogoniometer. The corresponding relaxation time $\tau$ of the extruded dispersion was 0.1 s.

This dispersion was coated on a subbed cellulose triacetate support by means of an extrusion nozzle with a flow rate of 12.2 $m.min^{-1}$ whereas the moving speed of the support was 80 $m.min^{-1}$. The coating ratio was 65 g of emulsion per sq.m.

The photographic and physical properties of the light-sensitive silver halide dispersion were excellent.

The following two examples illustrate the influence of different concentrations of a viscoelasticity-enhancing agent on the viscosity, the modulus of elasticity and on the relaxation time of a 6% and a 12% gelatin solution.

EXAMPLE 5

To an aqueous solution containing 6% by weight of gelatin were added different amounts of KELCO SCS described hereinbefore in example 1. The different amounts of KELCO are expressed in % of the weight of gelatin. The explanation for the blanks in the first three lines of the table hereinafter (and also in the tables of the following examples) is that the modulus of elasticity $\gamma$ was so small (smaller than 2 dyne/sq.cm) that it could not be measured by means of the Weissenberg rheogoniometer.

It is clear that for a relative concentration of KELCO of 1% and higher, the relaxation time $\tau$ considerably decreases, pointing to a greater increase of the modulus of elasticity, as compared with the increase of the viscosity. The curves of FIG. 1 which is drawn on a logarithmic scale, and wherein the ordinate shows the viscosity $\eta$ and the modulus of elasticity $\gamma$, and wherein the abscissa shows the concentration of the added agent, in % of the weight of gelatin, visualise $\eta$ and $\gamma$ of the table hereinafter. The viscosity was measured on a Ferranti-Shirley viscosimeter at 1735 $s^{-1}$, whereas the modulus of elasticity was measured on a Weissenberg rheogoniometer.

| 6% gelatin g KELCO/ g gelatin % | viscosity $\eta$ cp | modulus of elasticity $\gamma$ dyne/sq.cm | relaxation time $\epsilon$ s | coating quality |
|---|---|---|---|---|
| 0 | 6.7 | — | — | 1 |
| 0.1 | 9.2 | — | — | 1 |
| 0.2 | 15.3 | — | — | 1 |
| 0.5 | 16.4 | 4.5 | 0.0364 | 2 |
| 1 | 39.0 | 22.3 | 0.0175 | 2 |
| 2 | 169.0 | 114.9 | 0.0147 | 3 |

The last column of the table relates to the results that have been obtained by coating a subbed polyethylene terephthalate support at a speed of 80 $m.min^{-1}$, the spacing between the orifice of the extrusion coater and the support being 1 mm and the stretch ratio being 4.

The values of said last column have the following meaning:

1=not coatable; the extruded ribbon of coating composition is teared in longitudinal strands, so that finally longitudinal coated bands are produced on the support which are separated by longitudinal uncoated bands, 2=coatable as a uniform layer; however, any disturbance such as the package of a support splice past the coater, or a brief interruption of the feeding of the coater, cause a disruption of the coating; the coating ribbon is not "self-restoring", 3=coatable as a uniform layer; the coating ribbon is self-restoring even after it has been interrupted for a longer period, e.g. by interruption of the feeding of the coating head.

EXAMPLE 6

To an aqueous solution of 12% by weight of gelatin were added different amounts of KELCO SCS. The different amounts are expressed in % of the weight of gelatin.

It is clear that for a relative concentration of KELCO of 0.2% and higher, the relaxation time $\tau$ considerably decreases, pointing to a greater increase of the modulus of elasticity, as compared with the increase of the viscosity. The curves shown in solid lines of FIG. 2 visualize $\eta$ and $\gamma$ of the table hereinafter. The viscosity was measured on a Ferranti-Shirley viscosimeter at 1735 $s^{-1}$, whereas the modulus of elasticity was measured on a Weissenberg rheogoniometer.

| 12% gelatin g KELCO g gelatin % | viscosity $\eta$ cp | modulus of elasticity $\gamma$ dyne/sq.cm | relaxation time $\epsilon$ s | coating quality |
|---|---|---|---|---|
| 0 | 42 | — | — | 1 |
| 0.1 | 66 | 3.8 | 0.11 | 1 |
| 0.2 | 68.2 | 10.2 | 0.0669 | 2 |
| 0.5 | 116.13 | 45.5 | 0.0255 | 2 |
| 1.0 | 396.5 | 248.3 | 0.0160 | 3 |
| 2 | 474.0 | 576.5 | 0.00822 | 3 |
| 5 | 1529 | 1214 | 0.0126 | 4 |

The last column of the table relates to the results that have been obtained by coating a subbed polyethylene terephthalate support at a speed of 75 $m.min^{-1}$, the spacing between the orifice of the extrusion coater and the support being 1.2 mm and the strength ratio of the extruded layer being 6. The values of the lst column have the same meaning as those of the table of the foregoing example 5. The value 4 stands for a composition that was coatable in itself, but that yet was not coated because the viscosity was considered too high to be readily managable in actual production coating.

Figure 2:
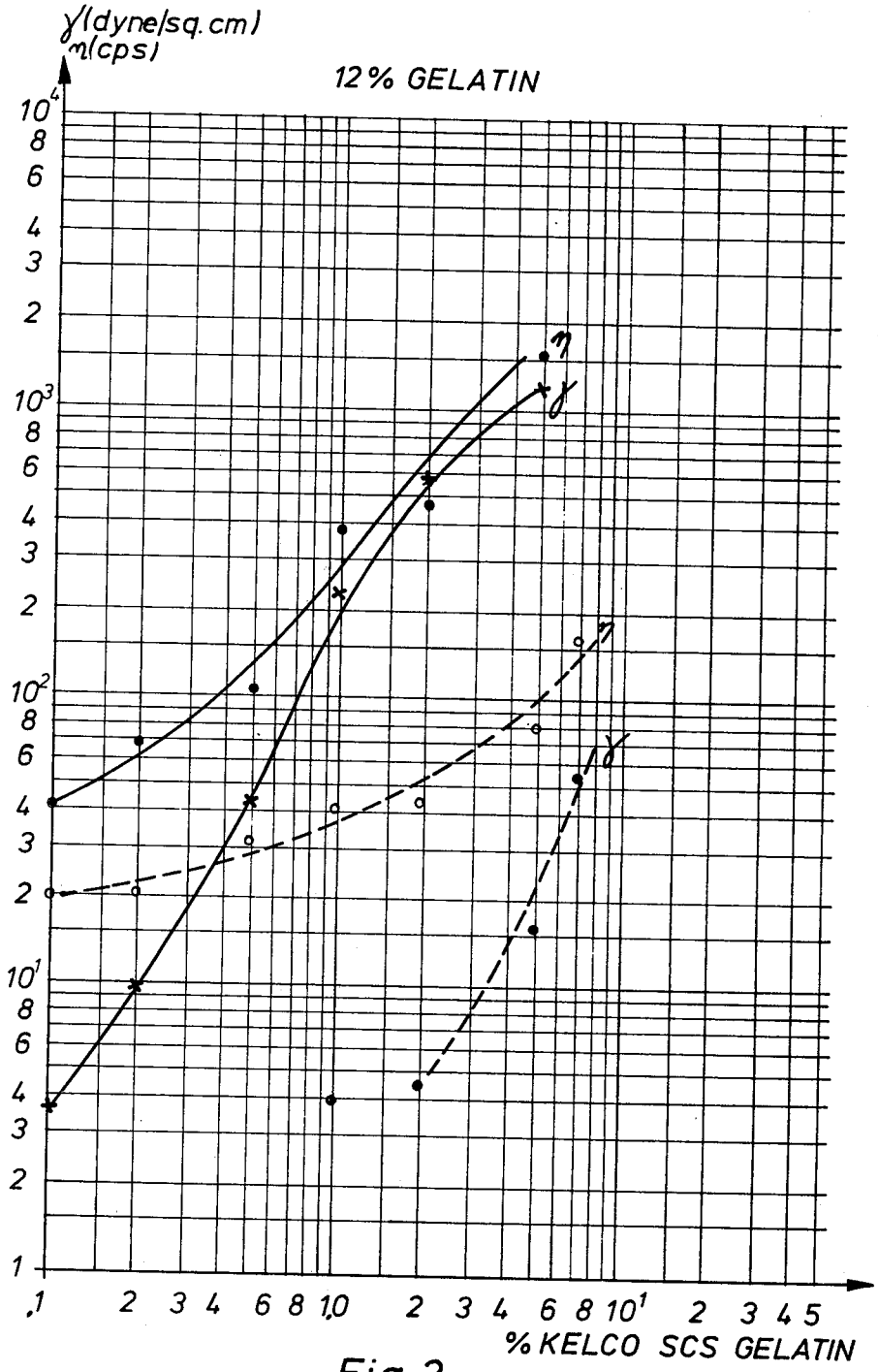
FIG. 2 is a graph, illustrating in drawn lines $\eta$ and $\gamma$ of a 12% gelatin solution as a function of the concentration of KELCO SCS, of example 6 and in broken lines $\eta$ and $\gamma$ of example 7.

From the above examples 5 and 6 and the corresponding FIGS. 1 and 2, it may be derived that for the lower limits of the extrusion process according to the invention, namely a viscosity of approximately 136 cps and a modulus of elasticity of 10 dyne/sq.cm, there is required a concentration of about 1.8% of KELCO SCS for a 6% gelatin solution and of about 0.5% KELCO SCS for a 12% gelatin solution.

EXAMPLE 7

Example 6 relating to a 12% gelatin solution as described hereinbefore was repeated, except that now a relatively low viscosity type of gelatin was used, namely gelatin that contained calcium in an amount of approximately 0.5% by weight. This example permits comparison with the behaviour of a relatively high viscosity type of gelatin as employed in all other examples.

It appears that much higher concentrations of KELCO SCS are required in order to obtain viscosity and elasticity values that approach the values obtained with the other type of gelatin. The curves drawn in broken lines in FIG. 2 visualize $\eta$ and $\gamma$ of the table hereinafter. The viscosity was measured on a Ferranti-Shirley viscosimeter at 1735 $s^{-1}$, whereas the modulus of elasticity was measured on a Weissenberg rheogoniometer.

| 12% gelatin (low viscosity type) g KELCO/g gelatin % | viscosity $\eta$ cp | modulus of elasticity $\gamma$ dyne/sq.cm | relaxation time $\epsilon$ s |
|---|---|---|---|
| 0.1 | 20 | — | — |
| 0.2 | 22 | — | — |
| 0.5 | 32 | — | — |
| 1.0 | 41 | 4.05 | 0.101 |
| 2.0 | 45 | 4.60 | 0.098 |
| 5.0 | 81 | 16.40 | 0.0494 |
| 7.0 | 165 | 55.0 | 0.0300 |

The following three examples illustrate the influence of three other viscoelasticity-enhancing agents on the viscosity, the modulus of elasticity and the relaxation time of a 6% gelatin solution.

EXAMPLE 8

To an aqueous solution containing 6% by weight of gelatin were added different amounts of polystyrene sulphonic acid (PSS) with a molecular weight of approximately 250.000. The different amounts are expressed in % of the weight of gelatin. The explanation for the blanks is the same as that mentioned in example 5, namely the modulus of elasticity that was too small to be measurable. The viscosity was measured on a Ferranti-Shirley viscosimeter at 1735 $s^{-1}$, whereas the modulus of elasticity was measured on a Weissenberg rheogoniometer.

| 6% gelatin g PSS/g gelatin % | viscosity $\eta$ cp | modulus of elasticity $\gamma$ dyne/sq.cm | relaxation time $\tau$ s |
|---|---|---|---|
| 0 | 6.7 | — | — |
| 0.1 | 7.3 | — | — |
| 0.2 | 9.3 | — | — |
| 0.5 | 12.7 | — | — |
| 1 | 17.1 | 2.4 | 0.071 |
| 2 | 64.8 | 12 | 0.054 |
| 5 | 335 | 216 | 0.0155 |

Figure 3:
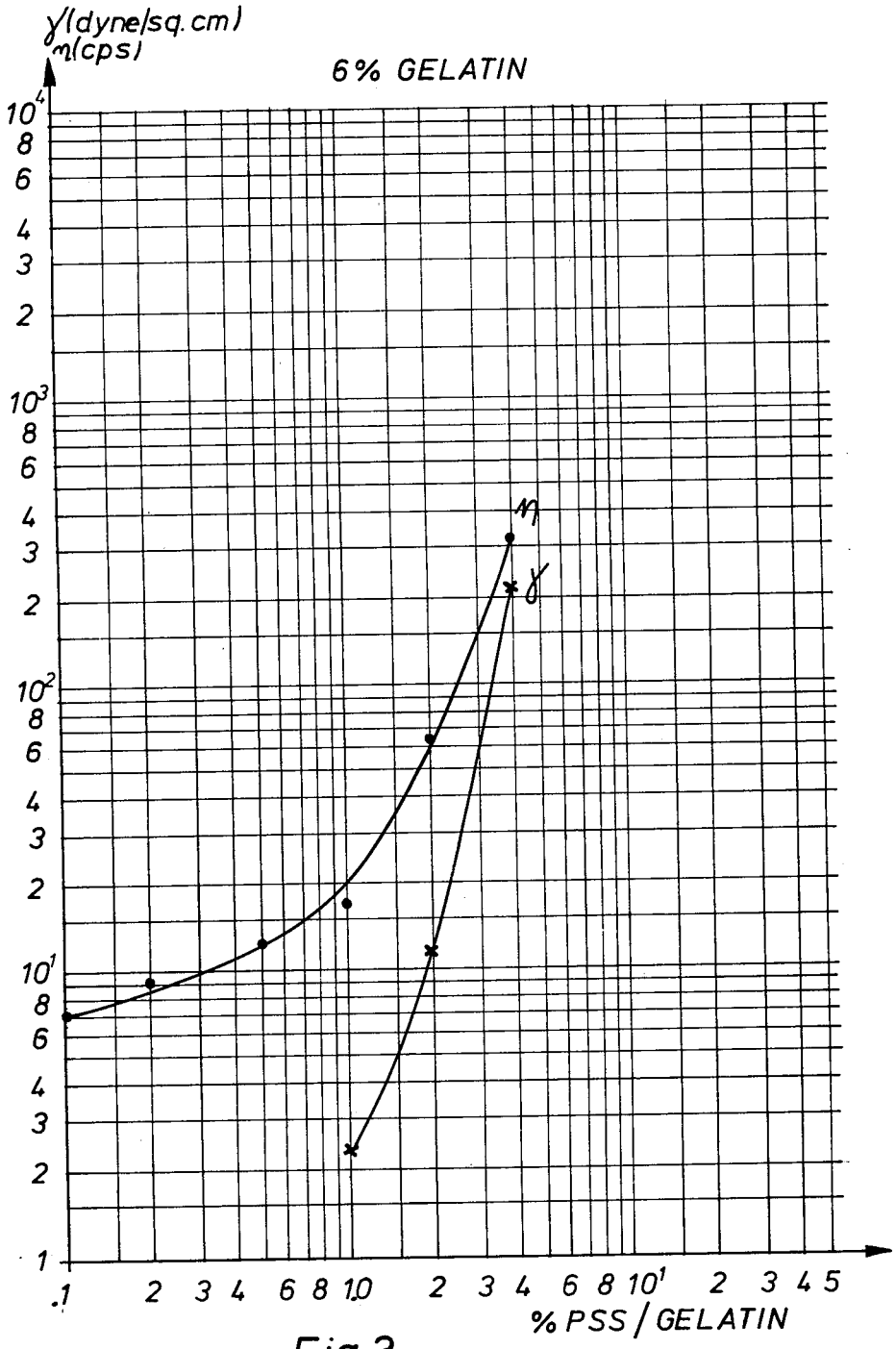
FIG. 3 is a graph, illustrating $\eta$ and $\gamma$ of a 6% gelatin solution as a function of the concentration of high molecular polystyrene sulphonic acid (PSS), of example 8.

The curves of FIG. 3 visualize $\eta$ and $\gamma$ of the table.

EXAMPLE 9

To an aqueous solution containing 6% by weight of gelatin were added different amounts of a mixture of 10 parts by weight of polystyrene sulphonic acid (PSS) with a molecular weight of approximately 55,000 and 1 part of chrome alum (CA). The different amounts of the mixture are expressed in % of the weight of gelatin. The viscosity was measured on a Ferranti-Shirley viscosimeter at 1735 $s^{-1}$, whereas the modulus of elasticity was measured on a Weissenberg rheogoniometer.

| 6% gelatin g PSS + CA/g gelatin % | viscosity $\eta$ cp | modulus of elasticity $\gamma$ dyne/sq.cm | relaxation time $\tau$ sec |
|---|---|---|---|
| 0 | 6.7 | — | — |
| 0.1 | 7.7 | — | — |
| 0.2 | 7.8 | — | — |
| 0.5 | 9.2 | — | — |
| 1 | 13.2 | — | — |
| 2 | 29.1 | — | — |
| 5 | 89.9 | 25 | 0.036 |

Figure 4:
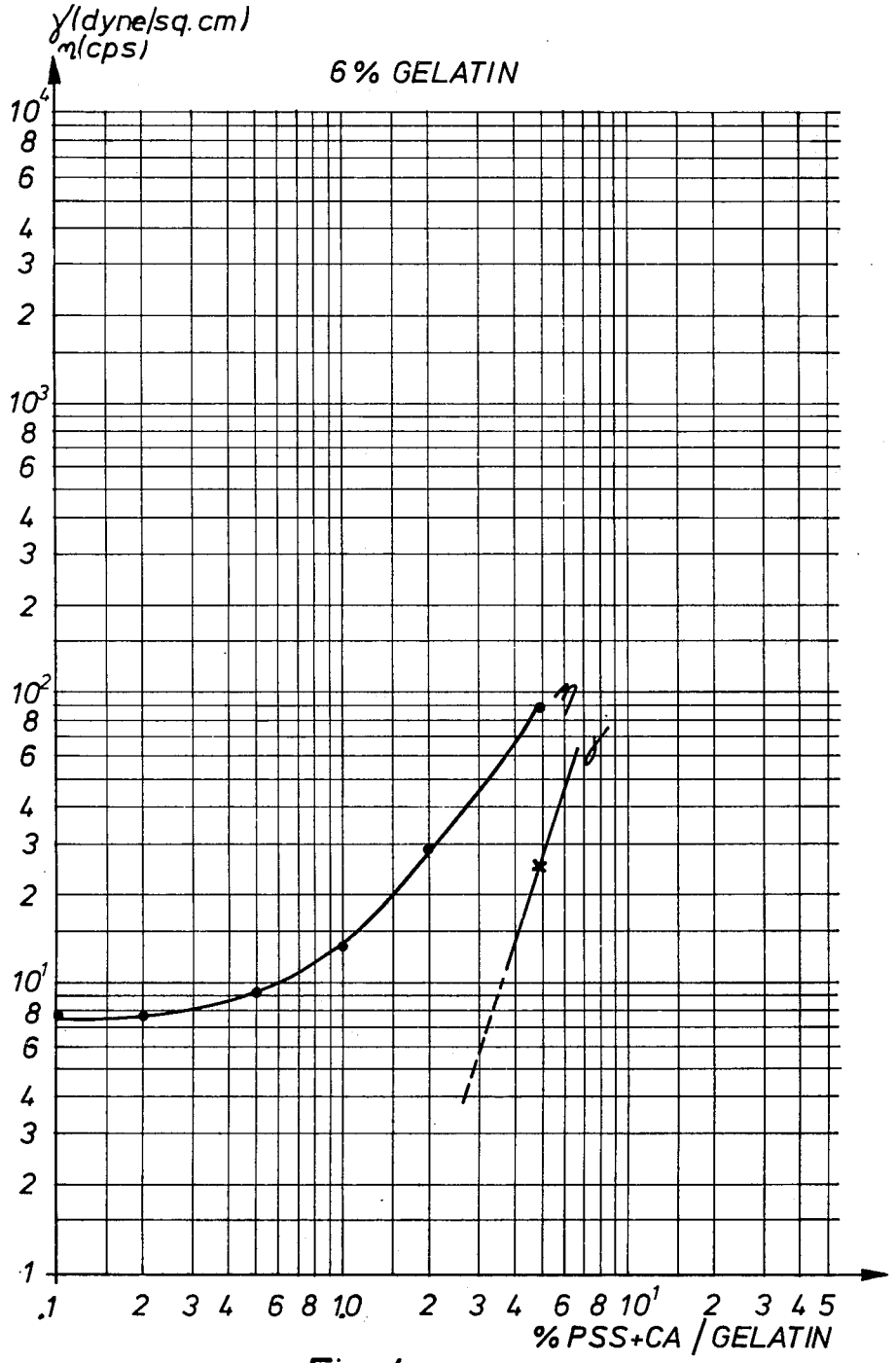
FIG. 4 is a graph, illustrating $\eta$ and $\gamma$ of a 6% gelatin solution as a function of the concentration of polystyrene sulphonic acid (PSS) and chrome alumn (CA), of example 9.

The curves of FIG. 4 visualize $\eta$ and $\gamma$ of the table. The broken portion of the curve for $\gamma$ points to the range that was not actually measured but that will very closely yield the plotted result.

EXAMPLE 10

Figure 5:
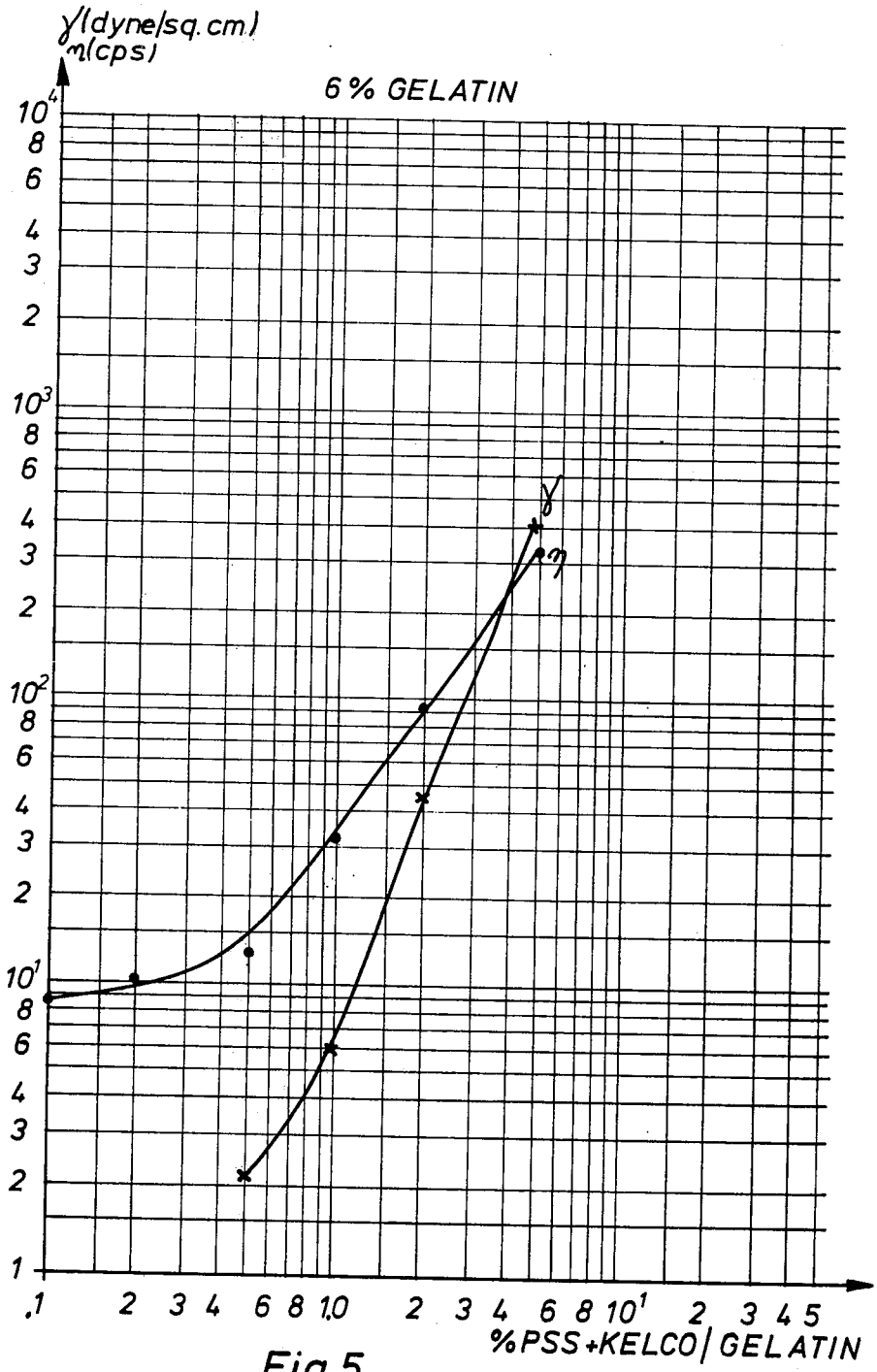
FIG. 5 is a graph, illustrating $\eta$ and $\gamma$ of a 6% gelatin solution as a function of the concentration of PSS and KELCO SCS, of example 10.

To an aqueous solution containing 6% by weight of gelatin were added different amounts of a mixture of 5 parts by weight of polystyrene sulphonic acid (PSS) with a molecular weight of approximately 250,000, and 1 part of sodium cellulose sulphate (KELCO SCS). The different amounts of the mixture are expressed in % of the weight of gelatin. The curves of FIG. 5 visualize $\eta$ and $\gamma$ of the table hereinafter. The viscosity was measured on a Ferranti-Shirley viscosimeter at 1735 $s^{-1}$, whereas the modulus of elasticity was measured on a Weissenberg rheogoniometer.

| 6% gelatin g PSS + SCS/g gelatin % | viscosity $\eta$ cp | modulus of elasticity $\gamma$ dyne/sq.cm | relaxation time $\tau$ s |
|---|---|---|---|
| 0 | 6.7 | — | — |
| 0.1 | 8.6 | — | — |
| 0.2 | 10.4 | — | — |
| 0.5 | 12.97 | 2.15 | 0.0603 |
| 1 | 32.83 | 6.07 | 0.054 |
| 2 | 94.23 | 40.6 | 0.0232 |
| 5 | 330.7 | 410.93 | 0.00805 |

It appears from the examples 5, 7, 8 and 9 that for increasing concentrations of the viscoelasticity enhancing agent, or a mixture of agents, the viscosity increases progressively, whereas the modulus of elasticity becomes measurable only up from about 0.5 to 2% and then increases rapidly. It appears further that for the extrusion coating of a 6% gelatin coating composition with a viscosity greater than approximately 136 cps and a modulus of elasticity greater than 10 dyne/sq.cm, the concentration of the viscoelasticity enhancing agent(s) must be higher than approximately 2%.

EXAMPLE 11

The following example illustrates the synergism that the admixture of two Newtonian solutions may produce a non-Newtonian solution.

A first solution was composed of 0.5% by weight of sodium cellulose sulphate (KELCO SCS) in water, and showed a viscosity of 26.3 cps at 38° C. and a modulus of elasticity that was so small ($\gamma \leqq 2$ dyne/sq.cm) that it was unmeasurable. In consequence, the relaxation time is very high, and this points to a liquid that is not capable of resuming its original shape after it has been subjected to a tensioning force. Such a liquid composition that is not stretchable and is Newtonian.

A second solution was composed of a 12% gelatin solution by weight in water, and showed a viscosity of 42.9 cps at 38° C., and a modulus of elasticity that was too small to be measured. This solution could not be stretched and thus was Newtonian.

From the two mentioned solutions there was then made a mixture of 240 g of the first solution and 1000 g of the second solution, so that said mixture contained in fact 1% of sodium cellulose sulphate with respect to the gelatin content.

Said mixture showed a viscosity of 149 cps at 38° C. and a modulus of elasticity of 63.3 dynes/sq.cm, measured by means of the apparatus described hereinbefore. The said mixture could perfectly be coated by extrusion coating. It is thus clear that by mixing two liquid compositions with a negligible modulus of elasticity, a liquid composition with a notable modulus of elasticity can be obtained.

EXAMPLE 12

The following example demonstrates the inherent rheological behaviour of two types of gelatin, namely a high viscosity type free of calcium salts, and a relatively low viscosity type of gelatin containing approximately 0.5% by weight of calcium, both gelatin types comprise no viscoelasticity enhancing agent whatsoever. The first table hereinafter illustrates the behaviour of the high viscosity type, the second table illustrates the behaviour of the low viscosity type of gelatin.

The viscosity was measured on a Ferranti-Shirley viscosimeter at 1735 $s^{-1}$, whereas the modulus of elasticity was measured on a Weissenberg rheogoniometer.

| % gelatin high viscosity type | viscosity $\eta$ | modulus of elasticity $\gamma$ | relaxation time $\tau$ |
|---|---|---|---|
| 5 | 4.49 | — | — |
| 10 | 21.8 | — | — |
| 15 | 88.35 | — | — |
| 20 | 112.83 | 7.04 | 0.16 |
| 25 | 291.2 | 67.18 | 0.0433 |
| 30 | 571.3 | 469.01 | 0.0122 |
| 35 | 2472 | 1537 | 0.0161 |
| 40 | 11379 | 9308 | 0.0122 |

Figure 6:
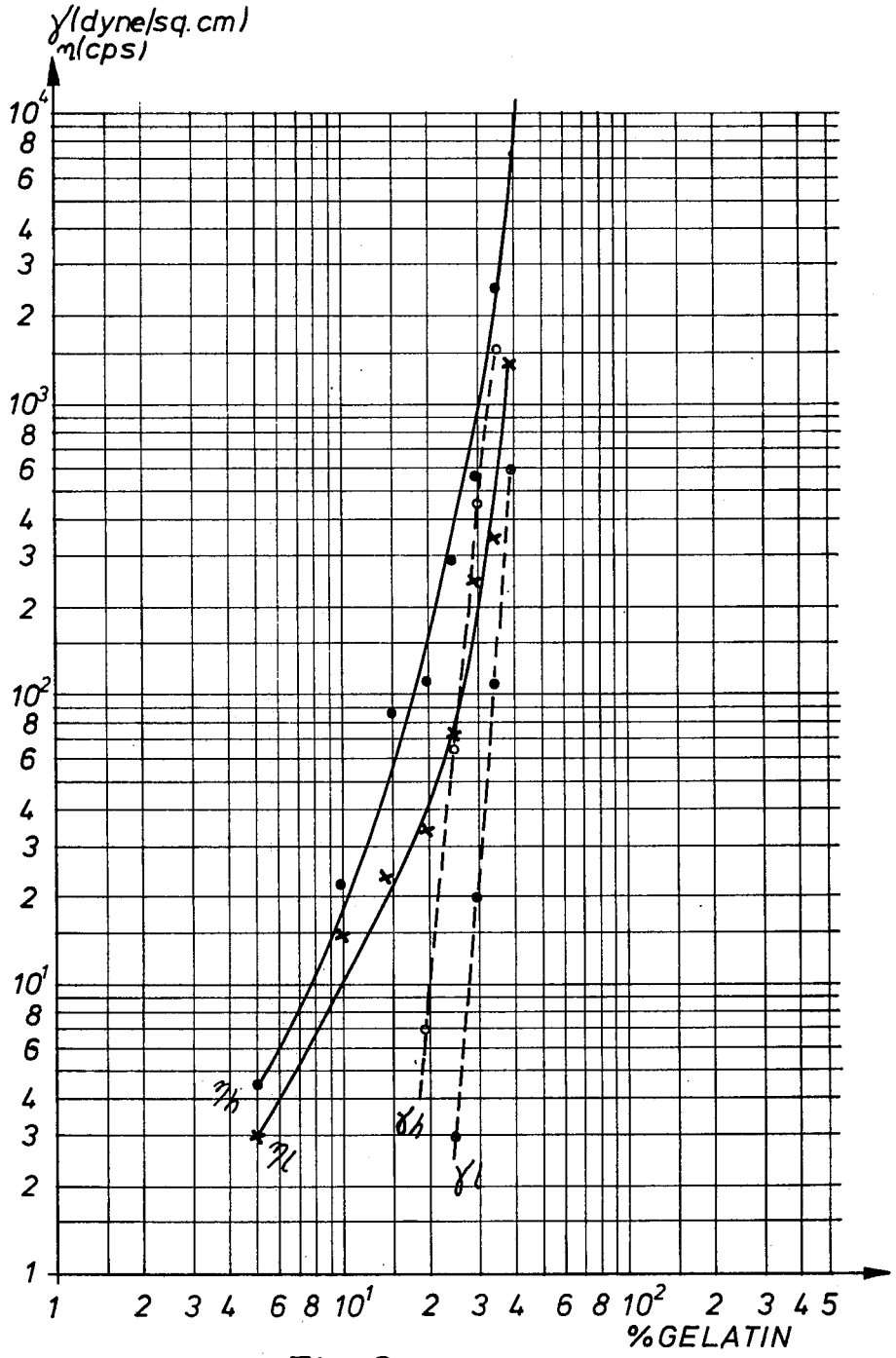
FIG. 6 is a graph, illustrating $\eta$ and $\gamma$ of a low viscosity type and of a high viscosity type of gelatin solution, as a function of the gelatin concentration of the solution.

The curves $\eta_h$ and $\gamma_h$ in FIG. 6 visualize $\eta$ and $\gamma$ of the table. It appears that at a gelatin concentration of 20.0%, $\gamma$ is approximately 10 dyne/sq.cm and $\eta$ is approximately 140 cps. At these conditions, the gelatin solution can be extrusion coated.

| % gelatin low viscosity type | viscosity $\eta$ | modulus of elasticity $\gamma$ | relaxation time $\tau$ |
|---|---|---|---|
| 5 | 3 | — | — |
| 10 | 15 | — | — |
| 15 | 24 | — | — |
| 20 | 35 | — | — |
| 25 | 72 | 2.9 | 0.248 |
| 30 | 252 | 20.5 | 0.123 |
| 35 | 359 | 121.4 | 0.0296 |
| 40 | 1426 | 629.6 | 0.0226 |

The curves $\eta_l$ and $\gamma_l$ in FIG. 6 visualize $\eta$ and $\gamma$ of the table. It appears at a 28% gelatin concentration, $\gamma$ is approximately 10 dynes/sq.cm and $\eta$ is approximately 140 cps. At these conditions, the gelatin composition can be extrusion coated.

We claim:

1. In a coating process in which a coating composition is forced at a given linear rate out of a narrow extrusion orifice in the form of a ribbon and received on the surface of a continuously moving support spaced from said orifice a distance of about 0.5–1.5 mm, said support travelling at a linear rate of 2–30 times the rate of extrusion of said ribbon, whereby said ribbon is stretched at the same rate in the range of 2–30 times and correspondingly attenuated as it is laid upon said web the improvement wherein said coating composition is aqueous and contains 2–20% by weight of gelatin, and the viscosity and elastic properties of said coating composition are adjusted by the inclusion therein of at least one viscoelasticity-enhancing agent in a proportion within the range of about 1–60% by weight of said gelatin and which is sufficient to impart to said coating composition a viscosity of from 136 to 1000 cps when measured at 38° C. at a shear rate of 1735 $s^{-1}$, and a modulus of elasticity $\gamma$ of 10 to 300 dyne/sq.cm when measured at 38° C. and at 5 Hz, the corresponding range of the relaxation time $\tau$ being from 0.0045 to 1.0 s.

2. A process according to claim 1, wherein the wet thickness of the layer applied by extrusion on the support is 8 to 125 $\mu$m.

3. A process according to claim 1, wherein the viscoelasticity-enhancing agent is a polymer bearing sulphate or sulphonic acid side groups.

4. A process according to claim 3, wherein the viscoelasticity-enhancing agent is polystyrene sulphonic acid.

5. A process according to claim 1, wherein the viscoelasticity-enhancing agent is a mixture of a polymer bearing sulphate or sulphonic acid side-groups or of polystyrene sulphonic acid with chrome alum.

6. A process according to claim 1, wherein the viscoelasticity-enhancing agent is a linear polysaccharide in which (1) at least $\frac{1}{3}$ part of the monosaccharide units have a 1–2 bond and the remaining monosaccharide units a 1–4 bond or (2) substantially all monosaccharide units have a 1–4 bond and at least 50% of the hydroxyl groups of the monosaccharide units are acetylated or replaced by a $OSO_3Me$ group in which Me represents an alkali metal.

7. A process according to claim 1, wherein the viscoelasticity-enhancing agent is the sodium salt of cellulose sulphate.

8. A liquid coating process according to claim 3, wherein viscoelasticity-enhancing agent comprises in addition to the polymer bearing sulphate or sulphonic acid side groups, or in addition to polystyrene sulphonic acid a linear polysaccharide in which (1) at least ⅓ part of the monosaccharide units have a 1–2 bond and the remaining monosaccharide units a 1–4 bond or (2) substantially all monosaccharide units have a 1–4 bond and at least 50% of the hydroxyl groups of the monosaccharide units are acetylated or replaced by a $OSO_3ME$ group in which ME represents an alkali metal.

9. A process according to claim 8, wherein the linear polysaccharide is the sodium salt of cellulose sulphate.

10. A process according to claim 1, wherein the gelatin-containing coating composition is a light-sensitive silver halide dispersion.

* * * * *